US005545047A

United States Patent [19]

Okada et al.

[11] Patent Number: 5,545,047

[45] Date of Patent: Aug. 13, 1996

[54] CONNECTOR

[75] Inventors: Hajime Okada; Masashi Saito, both of Yokkaichi, Japan

[73] Assignee: Sumitomo Wiring Systems, Ltd., Yokkaichi, Japan

[21] Appl. No.: 281,806

[22] Filed: Jul. 25, 1994

Related U.S. Application Data

[63] Continuation of Ser. No. 51,857, Apr. 26, 1993, abandoned.

[30] Foreign Application Priority Data

Apr. 28, 1992 [JP] Japan ..... 4-028456 U

[51] Int. Cl.[6] ..... H01R 13/62

[52] U.S. Cl. ..... 439/157; 439/153

[58] Field of Search ..... 439/152–160, 439/341, 372

[56] References Cited

U.S. PATENT DOCUMENTS

| | | | |
|---|---|---|---|
| 5,135,408 | 8/1992 | Suzuki | 439/157 |
| 5,135,410 | 8/1992 | Kawase et al. | 439/157 |
| 5,174,785 | 12/1992 | Endo et al. | 439/157 |
| 5,322,383 | 6/1994 | Saito et al. . | |

FOREIGN PATENT DOCUMENTS

| | | |
|---|---|---|
| 0459448 | 12/1991 | European Pat. Off. . |
| 974126 | 9/1950 | France . |
| 1590736 | 7/1965 | Germany . |
| 1590311 | 7/1970 | Germany . |
| 59-95579 | 6/1984 | Japan . |
| 4133370 | 12/1992 | Japan . |

OTHER PUBLICATIONS

European Search Report and Annex.

Partial English Language translation of German Patent No. 1,590,736.

*Primary Examiner*—David L. Pirlot

*Attorney, Agent, or Firm*—Greenblum & Bernstein, P.L.C.

[57] ABSTRACT

In a connector of male and female interlocking terminals, a lever is provided on a first connector in a freely pivoting manner. Guide pins provided on a second connector are inserted to guide channels formed in the first connector. A stopper block is provided on the top wall of the first connector. A spring is connected between the back side of the lever and the back side on the top wall of the first connector. The lever is pulled by the spring against the stopper block and is held at a disengaging position in which guide grooves formed inside the lever and the guide channels are aligned to form an inlet for the guide pins. Since the lever is automatically returned to the disengaging position by the spring even if the lever is accidentally turned, it is not necessary to re-rotate the lever to the disengaging position, making connecting operation smoothly.

3 Claims, 2 Drawing Sheets

CONNECTOR

This application is a continuation, of application Ser. No. 08/051,857, filed Apr. 26, 1993, now abandoned.

BACKGROUND OF THE INVENTION

1. Field of the Invention

The present invention relates to a connector with a lever used to reduce the force required for a male-female connection between mating connectors accommodating a wire harness therein and, more particularly, to a connector comprising a lever unit supported on one of the connectors.

2. Description of the Prior Art

Because a high connecting force is required for connecting multiple terminal connectors accommodating twenty or more terminals therein, a lever is commonly used to reduce the force. One example of such a connector is shown in FIG. 4.

This connector includes a mating plug unit 2 and a receptacle unit 1 having a receptacle space 1*a* for receiving the plug unit 2 therein. Generally, the receptacle unit 1 has a lever 3 that rotates freely on pins 4 provided on the outside walls thereof. The plug unit 2 has guide pins 5 provided on the outside walls 2*a* thereof. The guide pins 5 mate with the guide recesses 3*a* formed in inner side surfaces of the lever 3. When the lever 3 is rotated, the guide recesses 3*a* drive the guide pins 5 so that the plug unit 2 is moved in either the direction connecting or disconnecting with the receptacle unit 1.

For the mating operation of the plug unit 1 and receptacle unit 2 with the guide pins 5 captured in the guide recesses 3*a*, the lever 3 is turned clockwise when viewed in FIG. 4. To enable this operation smoothly, the connector is provided with engaging members on the plug unit 1 and the lever 3 such that the starting end 3*e* of the guide recess 3*a* on the lever 3 positions in the correct position relative to the guide pins 5 of the receptacle unit 2 to be connected.

Because the lever 3 rotates freely with respect to the pins 4, the starting end 3*e* of the guide recess 3*a* is no longer opposite to the guide pin 5 when the lever 3 is accidentally rotated, and the connecting operation for the units 1 and 2 cannot be smoothly completed. Because of this, there was the need to re-rotate the lever 3 counterclockwise to position the starting ends 3*e* in the correct position again with respect to the guide pins 5. Then, the connecting operation is repeated to engage the plug unit 2 with the receptacle unit 1.

Furthermore, if the locking force of the engaging members is increased so that the lever 3 can not easily rotate accidentally, a strong force is required to rotate the lever 3 and release this lock, and the difficulty for the worker is increased.

SUMMARY OF THE INVENTION

The present invention has been developed with a view to substantially solving the above described disadvantages and has for its essential object to provide an improved connector.

In order to achieve the aforementioned objective, a connector used to connect one pair of first and second terminals comprises a first connector member for accommodating said first terminal therein and provided with a first engaging means; a second connector member for accommodating said second terminal therein and provided with a second engaging means engageable to said first engaging means, said second connector member provided with a first positioning means; a lever means pivotally provided on said second connector member and provided with a third engaging means engageable to said first engaging means, said lever means having an axis for pivoting; and a biasing means provided between said second connector member and said lever unit for holding said lever means at a first predetermined position such that said lever means is held in contact with said first positioning means and said second and third engaging means are aligned to each other to form an inlet for said first engaging means, whereby when said lever unit pivots apart from said first predetermined position, said first engaging means is captured by said second and third engaging means and is then pressed by said third engaging means to move along said second engaging means so that said first connector member is firmly engaged with said second connector means when said lever means is located to a second predetermined position.

BRIEF DESCRIPTION OF THE DRAWINGS

These and other objects and features of the present invention will become clear from the following description taken in conjunction with the preferred embodiment thereof with reference to the accompanying drawings throughout which like parts are designated by like reference numerals, and in which.

DETAILED DESCRIPTION OF THE PREFERRED EMBODIMENTS

Figure 1:
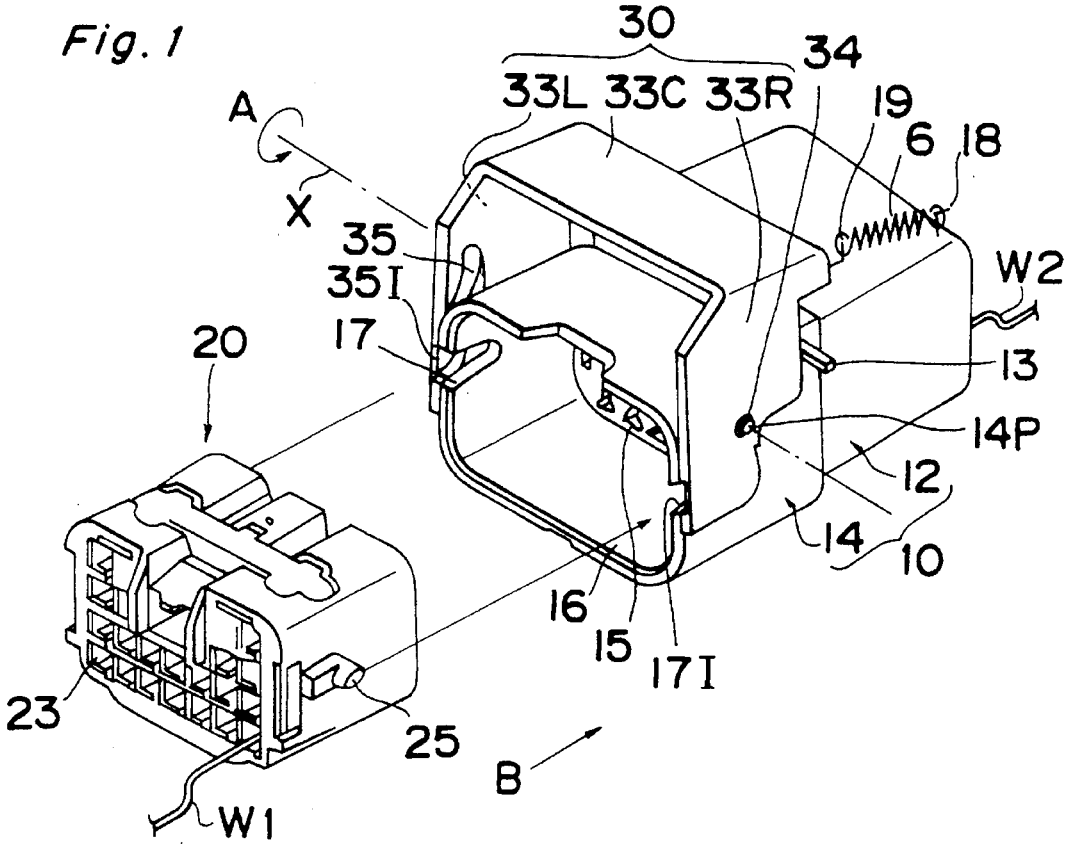
FIG. 1 is an exploded perspective view showing a connector according to a preferred embodiment of the present invention.

Referring to FIG. 1, a connector with a lever according to a preferred embodiment of the present invention is shown. The connector includes a mating plug unit 20 for accommodating a plurality of first electrical wires W1 with male terminals (not shown) and a receptacle unit 10 for accommodating a plurality of second electrical wires W2 with female terminals (not shown). Only one pair of wires W1 and W2 is shown in FIG. 1 for the sake of brevity. When the plug unit 20 and receptacle unit 10 are engaged with each other, first and second electrical wires W1 and W2 are electrically connected by mating male and female terminals thereof. It is needless to say that the receptacle unit 10 and plug unit 20 can accommodate the electrical wires with male terminals and female terminals, respectively. A lever unit 30 adapted to take the plug unit 20 in the receptacle unit 10 is pivotally mounted on the receptacle unit 10. The lever unit 30 is biased toward the backside of the receptacle unit 10 by a tension spring 6. The tension spring is captured by first and second hooks 18 and 19 provided on the receptacle unit 10 and the lever unit 30, respectively.

The plug unit 20 includes a plug housing generally in cubic shape defined by first and second end faces opposed to each other and four side walls extending between first and second end faces. Each two pair of four side walls are opposed to each other, defining right and left side walls and top and bottom side walls. The plug housing is provided with a plurality of first terminal chambers 23 extending between first and second end faces. The first wire W1 is accommodated inside each of first terminal chambers 23 such that the male terminal is located at the second end face (shown on the right side of plug unit 20 in FIG. 1). The plug unit 20 is further provided with a pair of guide pins 25 extending from the right and left side walls thereof.

The receptacle unit 10 includes a receptacle housing comprised of a accommodation portion 12 and a receptacle portion 14 which are integrally formed. The accommodation portion 12 is formed generally in a cubic shape defined by first and second sides opposed to each other and four side walls, opposite top and bottom side walls and opposite right and left side walls, extending between first and second end sides. The accommodation portion 12 is provided with a plurality of second terminal chambers 15 extending between first and second end sides thereof. The second wire W2 is accommodated inside each of second terminal chambers 15 such that the female terminal is located at the first end side (shown on the left side of the accommodation portion 12 in FIG. 1). At the first end side, the accommodation portion 12 is integrally connected with the receptacle portion 14.

The receptacle portion 14 is in a rectangular tube-like configuration defined by four side walls, opposite top and bottom side walls and opposite right and left side walls, having an opening at one side opposed to the first end side of the accommodation portion 12. Thus, the receptacle portion 14 is provided with a receptacle space 16 formed therein, and such receptacle space 16 is wide and deep enough to receive the plug unit 20 therein.

A pair of guide channels 17 are formed in right and left side walls of the receptacle portion 14 at a predetermined height. The guide channels 17 start from the open edge of right and left side walls 33R and 33L, at which channel inlets 17I are formed, toward the accommodation portion 12 by a predetermined length. The guide channels 17 receive and guide the guide pins 25 as the plug unit 20 is inserted in a direction B to the receptacle space 16. The receptacle portion 14 is provided with a pair of pivot pins 14P on the outside surfaces of right and left side walls thereof, respectively, in an alignment with a line X at predetermined position above the guide channels 17.

The receptacle portion 14 is further provided with an elongated stop member 13 on the top side wall of thereof. Stop member 13 protrudes from the right side wall of the receptacle portion 14 by a predetermined length for stopping pivotal movement of lever unit 30 and to locate lever unit 30 at a disengaging position, as shown in FIG. 1, by the biasing force of the spring 6. The tension force of spring 6 is enough strong to rotate the lever unit 30 against a resistance force such as weight and rotational friction of the lever unit 30, and to hold the lever unit 30 at the disengaging position. In other words, the lever unit 30 can rotate counterclockwise by a worker with a little force, and can be returned to the disengaging position, as shown in FIG. 1, when such worker's force disappears. Therefore, the difficulty for the worker to operate the lever unit 20 for engaging the connector is reduced.

The lever unit 30 is comprised of right and left flat arm members 33R and 33L opposed to each other and a connecting member 33C connecting the right and left arm members 33R and 33L, and is integrally formed in a generally reversed U-shaped configuration when viewed from the left side in FIG. 1.

The lever unit 30 has a pair of pin holes 34 respectively formed in the arm members 33R and 33L at a predetermined position. In inner surfaces of arm members 33R and 33L, a pair of curved guide grooves 35 are provided, respectively. The guide groove 35 opens at each of the left side edge of the arm members 33R and 33L, forming a groove inlet 35I thereat. The guide groove 35 extends from the inlet 35I toward the connecting member 33C, passing above the hole 34 such that the concave lines thereof face to the left side edge.

The lever unit 30 is installed on the receptacle portion 14 such that each of pivot pins 14P is rotatably inserted in pin holes 34. Thus, the lever unit 30 can pivot freely with respect to the axis X. It is to be noted that the distance between the pivot pin hole 34 and the space captured by the guide groove 35 and the guide channel 17 becomes short as the lever unit 30 rotates in the direction A. When the lever unit 30 is turned up, as shown in FIG. 1, the lever unit 30 is rotated clockwise until the right arm member 33R contacts with the stopper member 13. Thus, the lever unit 30 is located at the disengaging position, at which the groove inlet 35I almost overlaps the channel inlet 17I, as best shown in FIG. 2.

Figure 2:
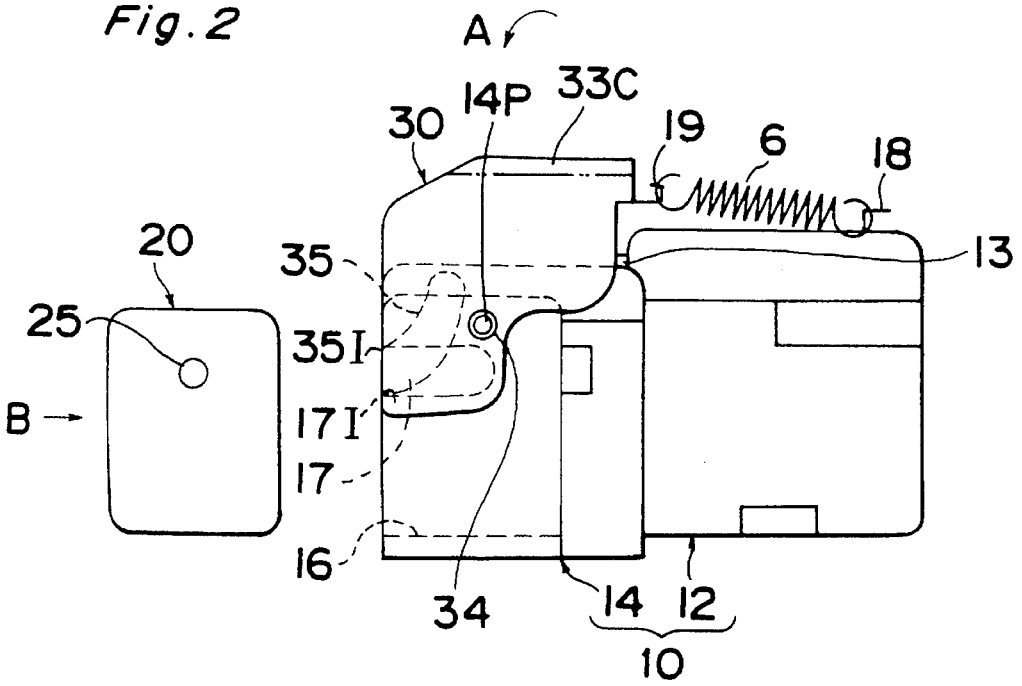
FIG. 2 is a side view showing the connector of FIG. 1 before being connected.

Referring to FIG. 2, the connector with lever unit 30 held at the disengaging position by the tension spring 6 is shown. Because the groove inlet 35I are aligned with the channel inlet 17I, the guide pins 25 of the plug unit 20 can be accurately inserted in the inlets 35I and 17I, enabling the plug unit 20 to enter into the receptacle space 16 smoothly. Since the lever unit 30 is automatically returned to the disengaging position by the tension spring 6 even if the lever unit 30 is accidentally turned counterclockwise-direction, it is not necessary to re-rotate the lever unit 30 for the plug unit 20.

The operation of connecting plug and receptacle units 20 and 10 are described with reference to FIGS. 2 and 3. When connecting the receptacle and plug units 10 and 20, the lever unit 30 is first turned back to the disengaging position by the tension spring 6, as shown in FIG. 2. At the beginning of this connection, the guide pins 25 of the plug unit 20 is inserted to the groove inlet 35I of the lever unit 30 and the channel inlet 17I of the receptacle unit 10.

Then, the lever unit 30 is lifted up and rotated counterclockwise in the arrow direction A, the guide grooves 35 capture and press the guide pins 25 by the upper edge thereof. Further rotation of the lever until 30 causes the guide pins 25 to move inside along the guide channel 17. This is because the distance between the hole 34 and the space captured by the guide groove 35 and the guide channel 17 becomes short as the lever unit 30 rotates in the direction A, as described above. Then, the plug unit 20 is pulled into the receptacle unit 10, creating a positive contact between the female and male terminals of wires w1 and W2 held in the chambers 23 and 15.

When the lever unit 30 is thereafter rotated in the counterclockwise direction, the plug unit 20 is inserted deeply into the receptacle space 16 and is connected with the receptacle portion 14. Because the force is applied to the arms of the lever unit 30 which turns on pivot pins 14, the principle of a lever and fulcrum works to reduce the force required to establish a positive connection between the plug and receptacle units 20 and 10, terminating the lever unit 30 to an engaging position, as shown in FIG. 3.

Figure 3:
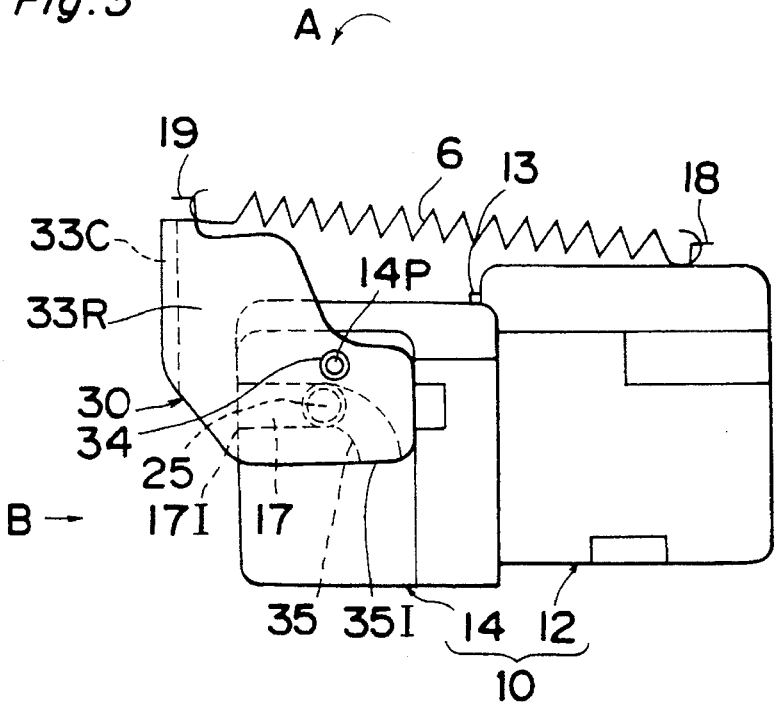
FIG. 3 is a side view showing the connector of FIG. 1 after being connected.
Figure 4:
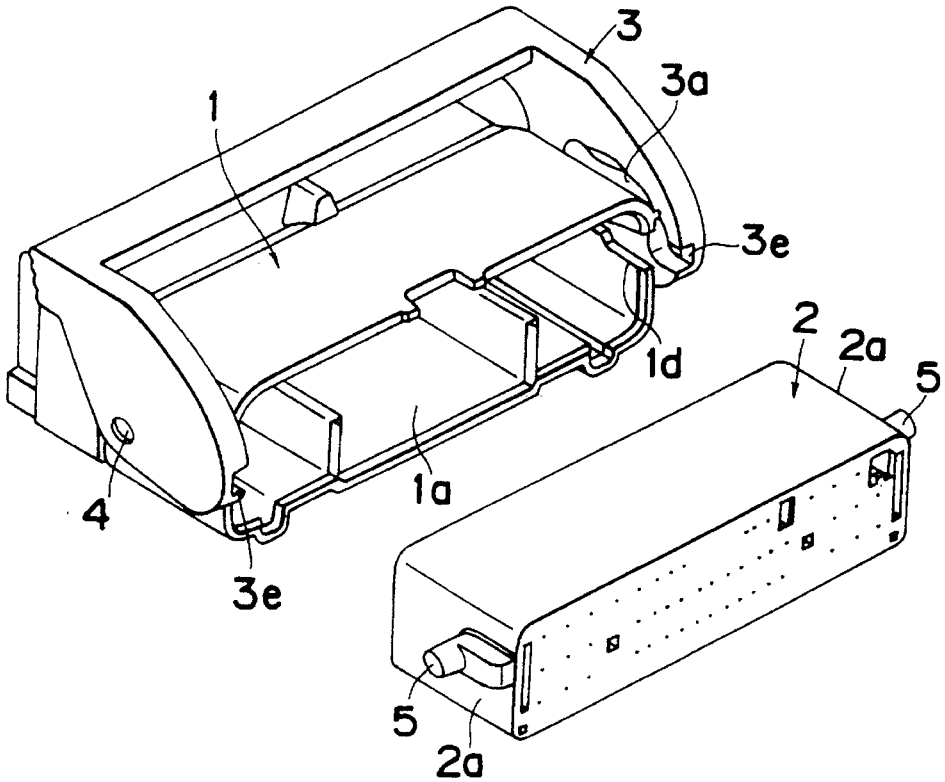
Fig. 4 PRIOR ART
FIG. 4 is an exploded perspective view showing a conventional connector.

Referring to FIG. 3, the connector firmly connected by the lever unit 30 located at the engaging position is shown. Because the connecting force of both units 10 and 20 is strong when the receptacle unit 10 and the plug unit 20 are connected, the lever unit 30 will not rotate in the clockwise direction to part from the engaging position by the tension spring 6.

The releasing of the plug unit 20 from the receptacle unit 10 can be carried out as follows. First, the lever unit 30 is rotated clockwise apart from the engaging position, so that the right side edge of the guide grooves 35 press the guide pins 25 to move the plug unit 20 along the guide channel 17 in the direction opposite to the direction B. Then, the lever unit 30 is held at the disengaging position by the tension spring 6. Therefore, the plug unit 20 can separate from the receptacle portion 14 of receptacle unit 10 if then pulled, as shown in FIG. 2.

It is to be noted that the lever unit 30 and guide pins 25 can be provided on the receptacle unit 10. In this case, the one end of the tension spring 6 can be is supported on the plug unit 20. Furthermore, the tension spring 6 can be mounted on other suitable portion than the right side portion of the connector, for example at the center or left portions thereof. The positioning member 13 Can be provided any place of the connector suitable to hold the lever unit 30 in the disengaging potion against the pulling force of the tension spring 6.

With a connector according to the present invention, since the lever unit 30 is held in contact with the stop member 13 by the tension spring 6, the groove inlets 35I is aligned with the channel inlet 17I to form a pass for the guide pins 25. The spring force holds the lever unit 30 in the disengaging position, and even if the lever unit 30 is accidentally rotated, the spring 6 automatically returns the lever unit 30 at the correct position. Furthermore, because a spring force is enough weak to simply hold the lever unit 30 at the disengaging potion, the lever unit 30 can be operated with a little force.

Although the present invention has been fully described in connection with the preferred embodiment thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A connector used to connect one pair of first and second terminals comprising:

a first connector member for accommodating said first terminal therein and provided with a first engaging means;

a second connector member for accommodating said second terminal therein and provided with a second engaging means engageable to said first engaging means, said second connector member provided with a first positioning means;

a lever means pivotally provided on said second connector member and provided with a third engaging means engageable to said first engaging means, said third engaging means being a continuously curved groove having a first inner surface and a second opposed outer surface, said inner surface being shorter than said outer surface to form a substantially convex curved shape, and first and second ends, said first end being open for reception of said first engaging means, the distance between said first and second opposed surfaces being substantially constant, said lever means having an axis for pivoting, said outer surface being closer than said inner surface to said axis; and a biasing means provided between said second connector member and said lever means for holding said lever means at a first predetermined position such that said lever means is held in contact with said first positioning means and said second and third engaging means are aligned with each other to form an inlet for said first engaging means, whereby when said lever means initially pivots apart from said first predetermined position, said first engaging means is captured by said second engaging means and between said first and second opposed surfaces of said curved groove, and is then pressed by said curved groove to move along said second engaging means by further pivoting of said lever means by an angle of substantially 90°, so that said first connector member is firmly engaged with said second connector member when said lever means is located at a second predetermined position.

2. A connector as claimed in claim 1, wherein the distance between a space commonly captured by both said second engaging means and groove and said axis becomes shorter as said lever means pivots from said first predetermined position to said second predetermined position.

3. A connector as claimed in claim 1, wherein said biasing means comprises a spring having a tension strong only enough to hold said lever means in said first predetermined position, enabling said lever means to be rotated toward said second predetermined position with little force.

* * * * *